United States Patent [19]

Boxall

[11] 4,039,099

[45] Aug. 2, 1977

[54] SECURING OF RIVETS TO PORTABLE ARTICLES

[75] Inventor: Charles W. Boxall, Norwich, England

[73] Assignee: National Can Corporation, Chicago, Ill.

[21] Appl. No.: 657,191

[22] Filed: Feb. 11, 1976

[51] Int. Cl.[2] ..... B65D 25/32

[52] U.S. Cl. ..... 220/91; 16/114 R; 29/243.52; 29/512; 85/37; 190/58 A; 220/94 R

[58] Field of Search ..... 220/94 R, 94 A, 91, 220/92, 95, 272; 16/125; 29/512, 523, 243.52, 243.53; 190/58, 57; 113/120 J; 403/282, 285; 85/37; 151/41.72; 224/45 P

[56] References Cited

U.S. PATENT DOCUMENTS

| | | | |
|---|---|---|---|
| 748,581 | 1/1904 | Carll | 16/125 |
| 1,833,795 | 11/1931 | Renshaw | 113/120 J |
| 2,029,328 | 2/1936 | Ljungström | 220/270 |
| 2,067,945 | 1/1937 | Peters | 29/523 |
| 2,096,823 | 10/1937 | Penny | 29/512 |
| 2,359,193 | 9/1944 | Bechik | 16/125 |
| 3,084,826 | 4/1963 | Ericson | 29/523 |
| 3,195,767 | 7/1965 | Henchert | 220/272 |

FOREIGN PATENT DOCUMENTS

| | | | |
|---|---|---|---|
| 559,369 | 10/1957 | Belgium | 220/91 |
| 1,323,261 | 7/1973 | United Kingdom | 220/94 R |

*Primary Examiner*—William Price
*Assistant Examiner*—Allan N. Shoap
*Attorney, Agent, or Firm*—Dressler, Goldsmith, Clement, Gordon & Shore, Ltd.

[57] ABSTRACT

A deformable metal rivet is permanently attached to a sheet metal wall by deforming a tubular extension on the free end of the rivet shank around an inwardly directed rim surrounding an opening in the sheet metal wall. The resultant article includes a rivet that has an extension turned around the inwardly directed rim surrounding a hole which receives the rivet to clinch the rivet on the sheet metal wall.

1 Claim, 9 Drawing Figures

FIG. 7
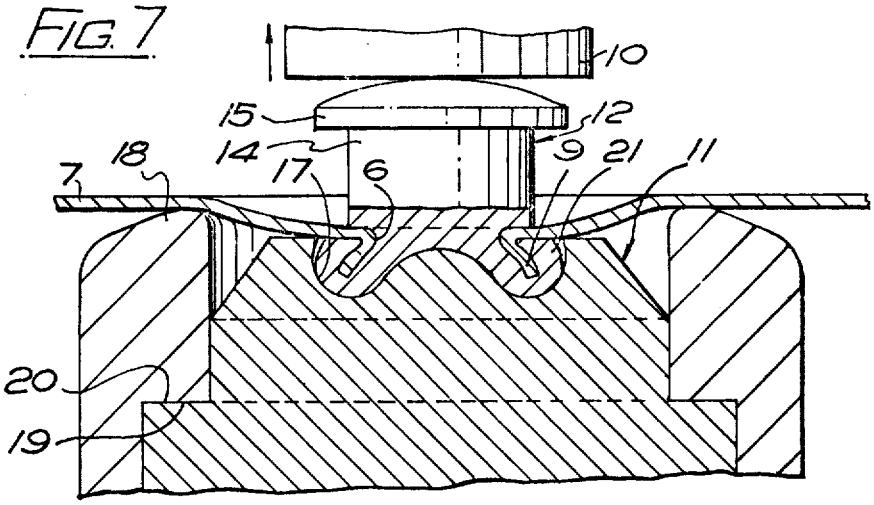
FIG 8
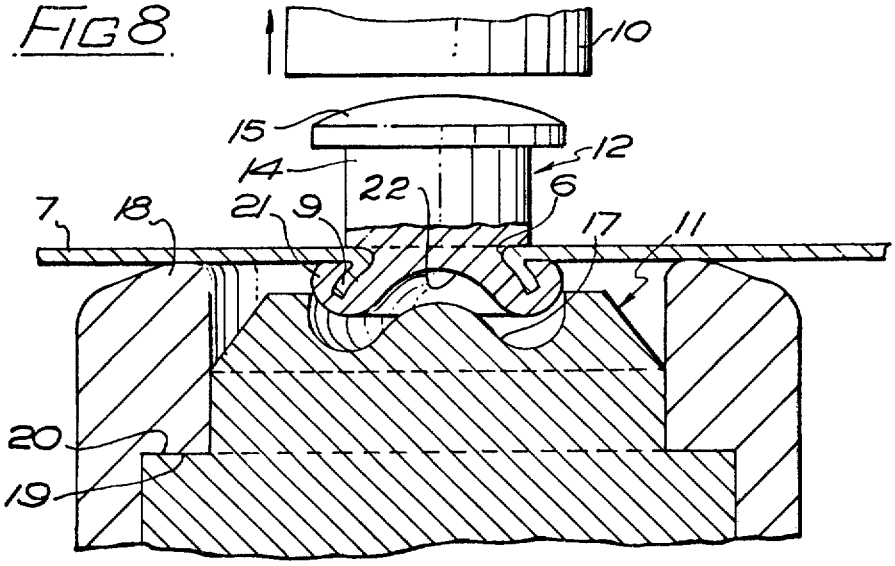
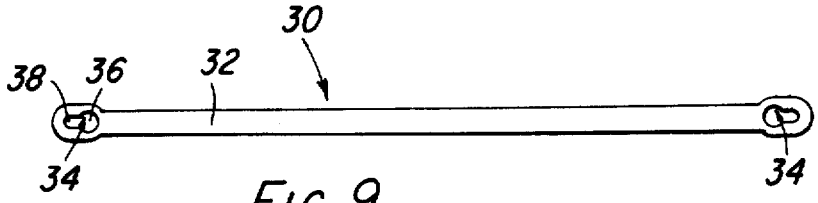
FIG. 9.

SECURING OF RIVETS TO PORTABLE ARTICLES

BACKGROUND OF THE INVENTION

This invention relates to the securing of rivets to portable articles for the reception of carrying handles for the articles, and more particularly to such articles having wall portions formed from sheet metal, such as cans for holding paint or other substances.

Whereas U.K. Pat. Application No. 19652/72 describes how the rim of a hole for a rivet can be folded or turned back on to the associated wall portion to provide a certain amount of resilience to effect the required seal between the rivet and the wall portion, the object of the present invention is also to provide a stronger mechanical grip between the rivet and the wall portion than has hitherto been usual.

SUMMARY OF THE INVENTION

According to one aspect of the invention, therefore, a method of securing a deformable metal rivet to a sheet metal wall portion of a portable article comprises forming a hole in the wall portion with an inwardly directed rim, inserting a rivet into the hole, and deforming the rivet in a manner such that it is first turned round the inwardly directed rim of the hole and then clenched thereon.

The two-stage deformation of the rivet results in the inwardly directed rim of the hole being prevented from being folded or turned back on to the associated wall portion. However, as the rivet is turned round the rim the latter is deformed towards the associated wall portion so as to become keyed in the deformed material of the rivet and be gripped tightly when the rivet is clenched thereon, whereby the rivet is very firmly sealingly secured to the wall portion. Indeed, the rivet is so firmly secured that it cannot be parted from the wall portion by pulling the rivet without effecting irreparable damage to the wall portion.

According to another aspect of the invention, a portable article has a pair of metal rivets each secured to a respective wall portion of the article with shanks of the rivets, each of which has a head, protruding outwardly from the wall portions, wherein the wall portions are of sheet metal and each has a hole with a rim directed inwardly, and the associated rivet has an extension fitting through the hole, turned round the inwardly directed rim of the hole and clenched thereon.

A carrying handle having a pair of apertures thereon of a size intermediate the shanks and the heads of the rivets may be secured to the article by passing each rivet through a respective one of the apertures in the handle before the extension is fitted through the hole and deformed. Alternatively, the rivets may be arranged to receive a detachable carrying handle, for example as disclosed in U.K. Pat. Specification No. 1,323,261.

The extension of the rivet is preferably initially tubular so as to facilitate turning it round the inwardly directed rim of the hole, but the formation of tooling for effecting deformation of the rivet (whether provided with a tubular extension or not) is important in ensuring the two-stages of deformation.

All these aspects of the invention will now be described with reference to the accompanying drawings which show in enlarged fragmentary sections various stages in the application of a rivet to a sheet metal wall portion.

BRIEF DESCRIPTION OF THE SEVERAL VIEWS OF THE DRAWINGS

FIGS. 4 through 7 show the various stages of rivet and rim deformations and the position of the punch and anvil at each stage;

FIG. 8 shows the final condition of the rivet and wall after the rivet is clenched on the wall; and FIG. 9 is a plan view of a carrying handle adapted to be attached to the rivets.

DETAILED DESCRIPTION

Figure 1:
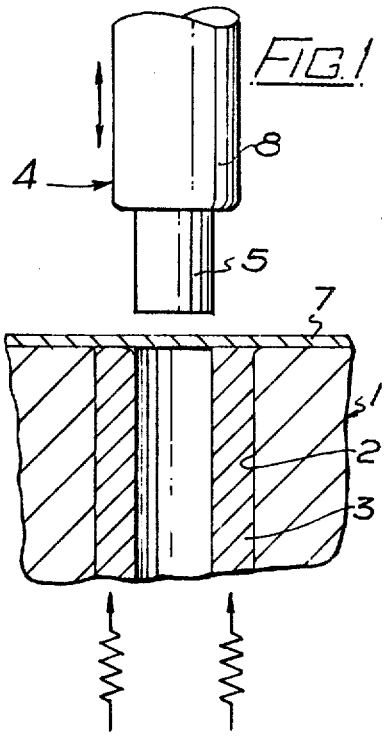
FIG. 1 shows a die and piercing punch for forming a hole and inwardly directed rim in a wall portion of an article.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Figure 2:
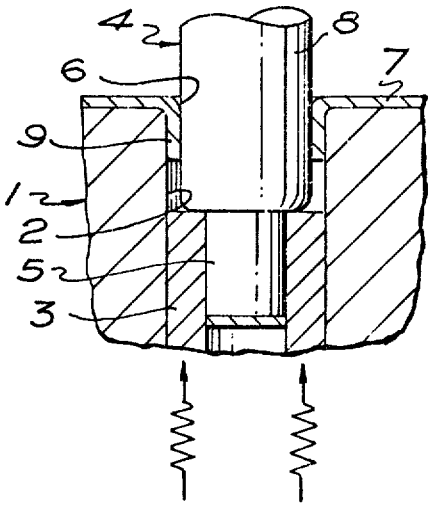
FIG. 2 is a view similar to FIG. 1 showing the parts after the hole and rim have been formed.
Figure 3:
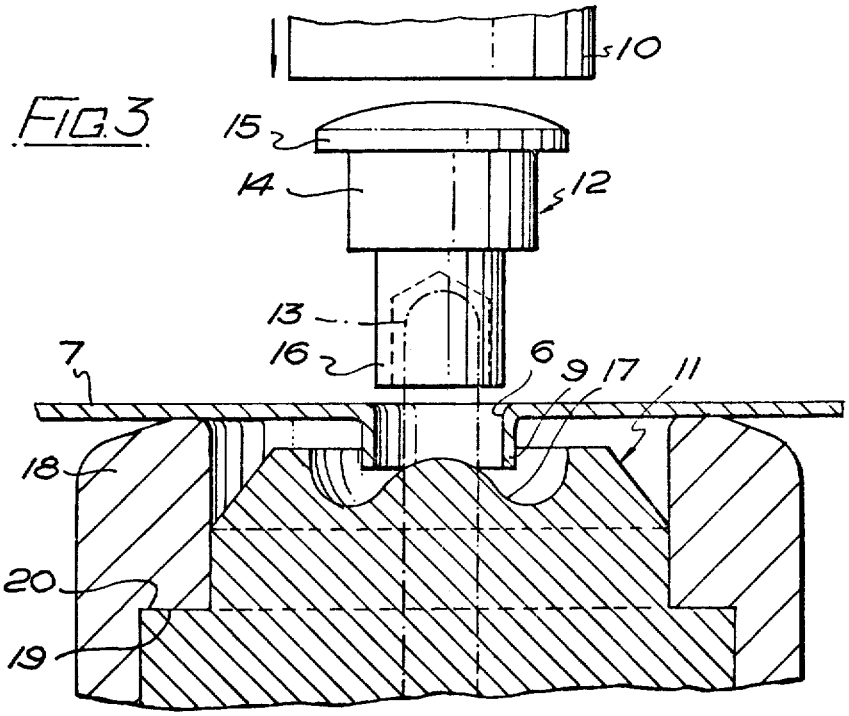
FIG. 3 shows a punch, anvil and rivet arranged for attachment to the wall portion.
Figure 4:
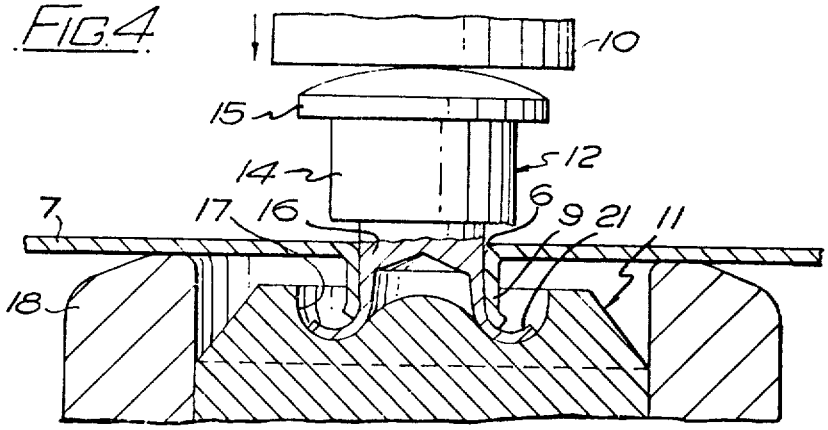
Figure 5:
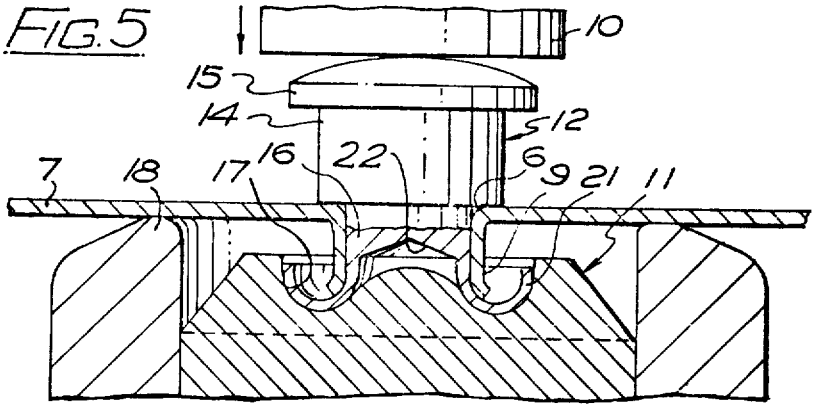
Figure 6:
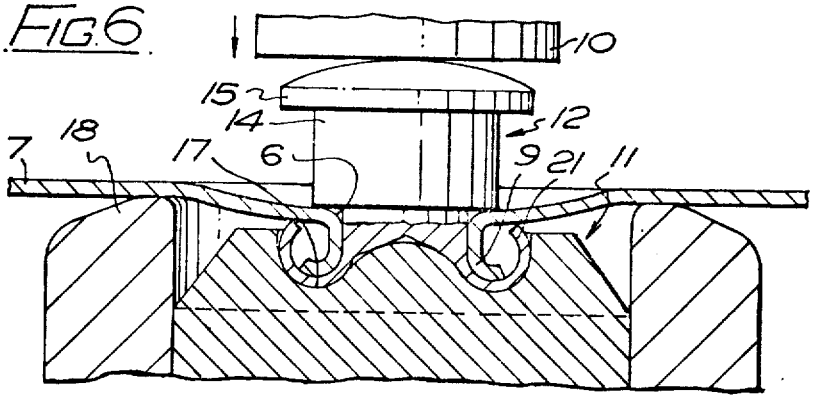

In FIGS. 1 and 2 a die 1 has a recess 2 in which a sleeve 3 is spring-loaded upwardly, and a piercing punch 5 has a leading portion 5 for piercing a hole 6 in a sheet metal wall portion 7. Piercing punch 4 has an enlarged body portion 8 which has a diameter less than the recess 2 in the die 1 but greater than the opening in shade 3 for deforming the rim 9 of the pierced hole into the recess 2. The spring-loaded sleeve 3 serves to eject the rim 9 of the pierced hole from the recess 2 when the punch 4 is withdrawn.

in FIGS. 3 to 7 a rivetting punch 10 is reciprocable towards and away from an anvil 11 to effect driving of a deformable metal rivet 12 through the hole 6 in the sheet metal wall portion 7 and rivetting therein. The rivet may be fed by any of the usual magazine feeds (not shown); and the anvil may be provided with an axially retractable central pin 13 (shown in broken line in FIG. 3 only) for assisting manual location of the hole in the wall portion and possibly also a hole in one end of a metal handle (not shown) to be rivetted at the same time, but an anvil in an automated production line will not require such a pin as precise location can be effected as part of accurately controlled intermittent movement of the metal sheet.

The rivet 12 has a shank 14, with enlarged head 15 at one end, and reduced extension 16 at the other end of the shank for fitting through the hole 6. The extension 16 of the rivet is tubular, so as to assist the operative surface 17 of the anvil 11 is producing the desired deformation of the rivet.

The anvil 11 has a coaxial annular element 18 extending beyond the operative surface 17 to an extent such that the edge of the rim 9 of the hole 6 in the sheet metal wall portion 7 directed towards the anvil cannot make contact with the operative surface. For convenience of manufacture and maintenance the annular element 18 is formed as a separate sleeve counterbored to form an annular abutment 19 seating on an annular shoulder 20 on the anvil.

The extension 16 of the rivet 12 driven by the rivetting punch 10 is deformed by the operative surface 17 of the anvil 11, the deformed material 21 (FIGS. 4 to 6) of the rivet being turned — in usual manner — but because the edge of the rim 9 of the hole 6 in the sheet metal wall portion 7 canot make contact with the anvil, the deformed material of the tubular end portion 16 of the rivet is turned round the rim of the hole until the deformed material reaches the associated wall portion (FIG. 6), when the rim of the hole will be deformed towards the associated wall portion and then become keyed in the deformed material of the rivet as the latter is clenched thereon (see FIG. 7). This results from the fact that the convex surface 17 is moved towards and ultimately engages a surface 22 defined on the inner end of shank 14 within the confines of hollow tubular end portion 16.

Between the stage at which the shank 14 of the rivet 12 makes contact with the wall portion 7 around the hole (FIG. 5) and the stage at which the rivet is clenched (FIG. 7), the wall portion 7 flexes (see FIG. 6 and 7), but its resilience enables it to spring back after retraction of the rivetting punch 10 (FIG. 8).

It will be appreciated from FIGS. 7 and 8 that the rim 9 of the hole 6 in the wall portion 7 becomes keyed in the deformed material 21 of the rivet 12 and is gripped tightly, whereby the rivet is very firmly sealingly secured to the wall portion and cannot be parted therefrom by pulling the rivet without effecting irreparable damage to the wall portion.

FIG. 8 shows the tubular end portion 16 in its deformed condition and also shows the unique relation of rim 9 and deformed portion 21. In its final condition sheet metal rim 9 extends away from opening 6 and defines an acute included angle of substantially less than 90° with wall portion 7, when viewed in cross-section as illustrated in FIG. 8. The deformed metal 21 is clenched around the outwardly bent rim so as to be in contiguous engagement with the entire exposed surfaces of rim 9 and also engages the inner surface of wall portion 10.

In its final condition of the deformed metal of tubular rivet, the inner surface 22 is concave and concave surface 22 is arcuate in cross section down to the lowermost or inner end of deformed portion 21.

FIG. 9 shows an illustrative type of detachable carrying handle 30 which is fully described in U.K. Pat. Specification No. 1,323,261. Carrying handle 30 consists of an elongated strap 32 preferably formed from a flexible plastic material having elongated apertures 34 adjacent opposite ends. Each aperture has an enlarged circular portion 36 at one end and a reduced elongated portion 38 at the opposite end. Circular portion 36 has a diameter slightly greater than the diameter of head 15 while elongated portion 38 has a transverse dimension that is less than the diameter of head 15 and slightly greater than the diameter of shank 14. Thus, carrying handle 30 can be attached to rivets 12 by passing heads 15 through the enlarged circular portions 36 and carrying handle 30 moved relative to rivets 12 so that shanks 14 are received into elongated portions 38 while heads 15 overlay portions of the trap adjacent portions of strap 32.

What we claim is:

1. A portable article having a pair of metal rivets each of which is permenently secured to a respective flat wall portion of the article, each of said rivets including a solid shank portion engaging an outer surface of said flat wall portion and an enlarged head on an outer end of said shank spaced from said flat wall portion to receive a carrying handle, said shank having a reduced tubular end portion extending from an end opposite said enlarged head with said flat wall portion having an opening receiving said tubular end portion said flat wall portion having an inwardly directed rim integral therewith and surrounding said opening with said rim defining an acute included angle in cross section with said flat wall portion so that said rim extends away from said opening, said solid shank portion having a concave surface in cross section at said opposite end adapted to engage a tool for deforming said tubular end portion, said tubular end portion being permanently deformed completely around said rim and being contiguous to both opposed surfaces thereof, said tubular end portion engaging an inner surface of said flat wall portion to permanently secure said rivet to said flat wall portion.

* * * * *